US006341709B1

(12) United States Patent
Wilson

(10) Patent No.: US 6,341,709 B1
(45) Date of Patent: Jan. 29, 2002

(54) CAN WITH EASY OPEN END

(75) Inventor: Alastair Wilson, Wantage (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/424,791

(22) PCT Filed: May 19, 1998

(86) PCT No.: PCT/GB98/01448

§ 371 Date: Nov. 30, 1999

§ 102(e) Date: Nov. 30, 1999

(87) PCT Pub. No.: WO98/55366

PCT Pub. Date: Dec. 10, 1998

(30) Foreign Application Priority Data

Jun. 3, 1997 (GB) ..... 9711290

(51) Int. Cl.[7] ..... B65D 17/34; B65D 17/40; B21D 51/44

(52) U.S. Cl. ..... 220/270; 220/276; 413/14; 72/335; 72/379.4

(58) Field of Search ..... 220/270, 260, 220/265, 266, 268, 269, 271, 272, 273, 276; 72/335, 336, 337, 338, 379.2, 379.4; 413/12, 9, 14, 18, 58, 66, 67

(56) References Cited

U.S. PATENT DOCUMENTS

| | | | | | |
|---|---|---|---|---|---|
| 3,902,626 | A | * | 9/1975 | Jordan et al. | 220/268 |
| 4,015,744 | A | * | 4/1977 | Brown | 220/269 |
| 4,024,981 | A | * | 5/1977 | Brown | 220/269 |
| 4,862,722 | A | * | 9/1989 | Fraze et al. | 72/336 |
| 5,715,964 | A | * | 2/1998 | Turner et al. | 220/269 |

* cited by examiner

*Primary Examiner*—Nathan J. Newhouse
(74) *Attorney, Agent, or Firm*—Diller, Ramik & Wight

(57) ABSTRACT

A full aperture easy open end having a central panel, a circumferential score and a tab riveted to the central panel so that its nose is positioned above the score. When the end is first opened, the score is broken along an arc having a specific chord length. The end is of metal having a grain which is aligned to a tangent at one end of the chord. In a preferred embodiment, this "grain tangent" is also at minimum score residual.

12 Claims, 1 Drawing Sheet

CAN WITH EASY OPEN END

BACKGROUND OF THE INVENTION

This invention relates to an easy open end and, in particular, to a metal can end of the so-called "full aperture" type, having a circumferential score which enables a circular panel of the end to be removed for access to a product within the can.

An easy open can end having a full aperture easy opening feature typically comprises a seaming panel, a chuck wall and a countersink joining the chuck wall to a central panel. A circumferential score is provided adjacent the countersink and a metal tab is rive ed to the central panel so that its nose is positioned above the score. One example of such a can end is described in French patent application number 2687372.

In a can end having such a circumferential score, the nose of the metal tab pierces the score directly when the handle is lifted. Breaking the score takes place in three stages. Firstly, by lifting the handle, the score tears or "pops" and an initial arc is severed as the tab is lifted to the position where the tab is perpendicular to the end. By pushing the tab over in a second action until it meets the peripheral chuck wall of the end, the initial score tear is propagated. In the third stage, the tab and end panel are pulled out away from the can body so that the end peels away from the can body.

By breaking a greater arc in the second stage of opening, usually defined in terms of the length of the chord joining the ends of the initial arc, the tear force required to remove the central panel in the final stage is reduced. However, the maximum chord length achievable may be dictated by various factors, including the maximum tilting of the tab to meet the chuck wall. Furthermore, in order to achieve a larger chord length, the force required for the first stage of opening, i.e. the "pop" force, may exceed acceptable values. The present invention seeks to reduce tear force requirements by achieving a large chord length without adversely affecting the pop force requirements.

SUMMARY OF THE INVENTION

According to the present invention, there is provided a metal can end comprising a central panel; a circumferential score; and a tab fixed to the central panel adjacent the score with its longitudinal axis along a radius of the end such that, when the tab is raised, an arc of the score is broken, the arc having a chord joining its ends; characterised in that the grain or the metal end has an angle which is ±15° to 60° to the longitudinal axis of the tab.

When the tab is raised, an arc of the score is broken, the arc having a chord joining its ends. A tangent in the plane of the end and at one end of the chord is substantially parallel to the grain of the end.

According to another aspect of the present invention, there is provided a metal can end comprising a centre panel, a circumferential score and a tab fixed to the panel adjacent the score such that, when the tab is raised, an arc of the score is broken, the arc having a chord joining its ends; characterised in that the metal of the can end has a grain which is parallel to a tangent to the can end in the same plane as the can end and at one end of the chord.

In a preferred embodiment, the grain is between +/−10° to the tangent to the can end at one end of the chord.

The score may have a residual which is lower at the end of the chord having the tangent to which the grain is aligned than at the other.

According to a further aspect of the present invention, there is provided a method of making a can end such as is described above, the method comprising a) cutting blanks from a metal sheet; b) forming the blanks into end shells; c) lining the shells; d) feeding the shells into a conversion press; e) forming a score (10) and f) fixing a tab to the shell; characterised by, between steps d) and e): determining the orientation of each shell; lifting each shell and turning it until the shell has its grain substantially parallel to a predetermined tangential position; and characterised in that step f) is carried out such that the longitudinal axis of the tab is ±15° to 60° to the grain.

A preferred embodiment of the invention will now be described, by way of example only, with reference to the drawings, in which:

BRIEF DESCRIPTION OF THE INVENTION

DESCRIPTION OF THE PREFERRED EMBODIMENTS

Figure 1:
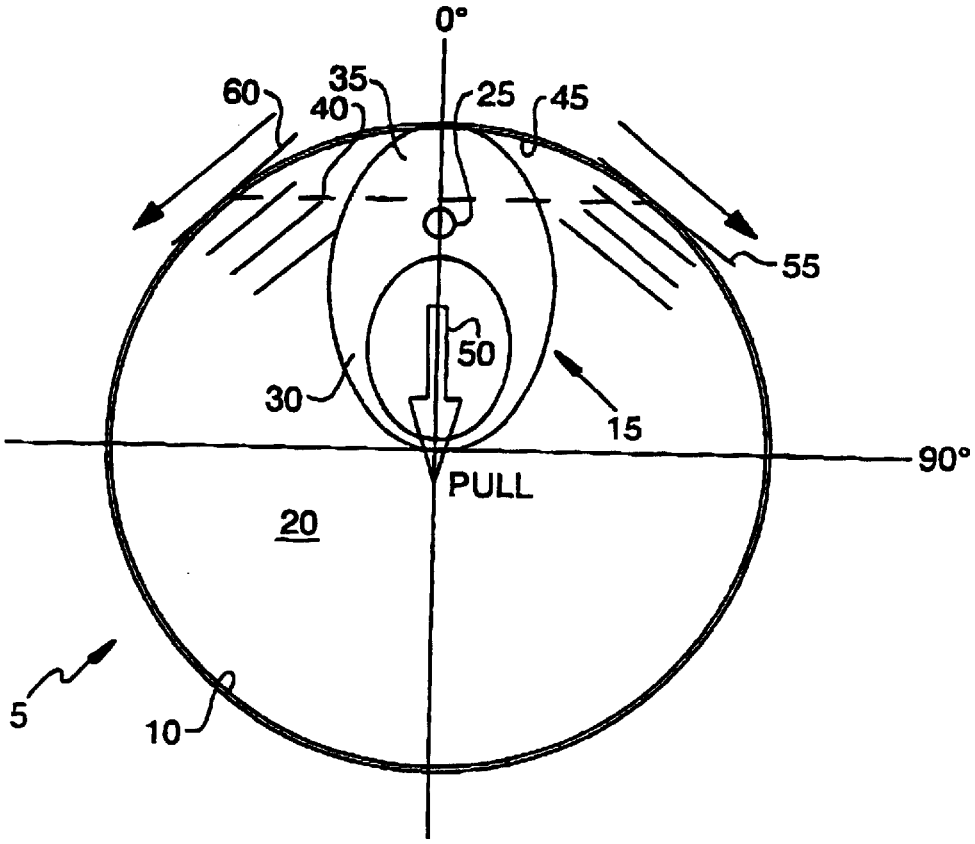
FIG. 1 is a schematic plan view of a can end.

The schematic of FIG. 1 shows a full aperture easy open end 5 having a circumferential score 10. The end is openable by means of a tab 15 fixed to a central panel 20 of the end, along a radius thereof. The tab 15 is fixed to the central panel 20 by means of a rivet 25 and has a ring pull handle 30 at one end and a nose 35 at its opposite end, adjacent the score 10.

In order to open the can end, the handle 30 is first raised and the tab pivots about the rivet 25 in order to "pop" the score 10. This action causes the central panel 20 to fold along a chord 40 as the score is broken along arc 45. Complete opening of the end is achieved by pulling along the radius in the direction of the large arrow 50, thereby removing the whole of the central panel 20.

In order to assess the effect of grain orientation on tear force, the tear force was measured with the grain at varying angles around the can end. The "grain angle" is defined as the angle between the radius of the end along which the user pulls the tab (i.e. the direction of arrow 50) and the grain direction, measured in the clockwise direction from arrow 50. The effect of the grain angle on tear force is shown in FIG. 2.

Although it was initially assumed that by pulling along the grain, i.e. at an angle of 0° or 180°, the tear force would be least, in fact these angles yielded the highest tear force readings. The lowest tear force was found at 135° to 150°. It is believed that since the central panel 20 folds along chord 40 in order to pop the score, in practice the tear force can be said to have a component along tangents at the ends of this chord, in the plane of the end. This explains the low reading at 135° to 150° since in theory lowest tear forces should then occur when the tangents are at ±45° (45° and 135°) to the pulling action, arrow 50. However, this did not explain why the tear force was high in the grain angle range of 35° to 50°.

Figure 2:
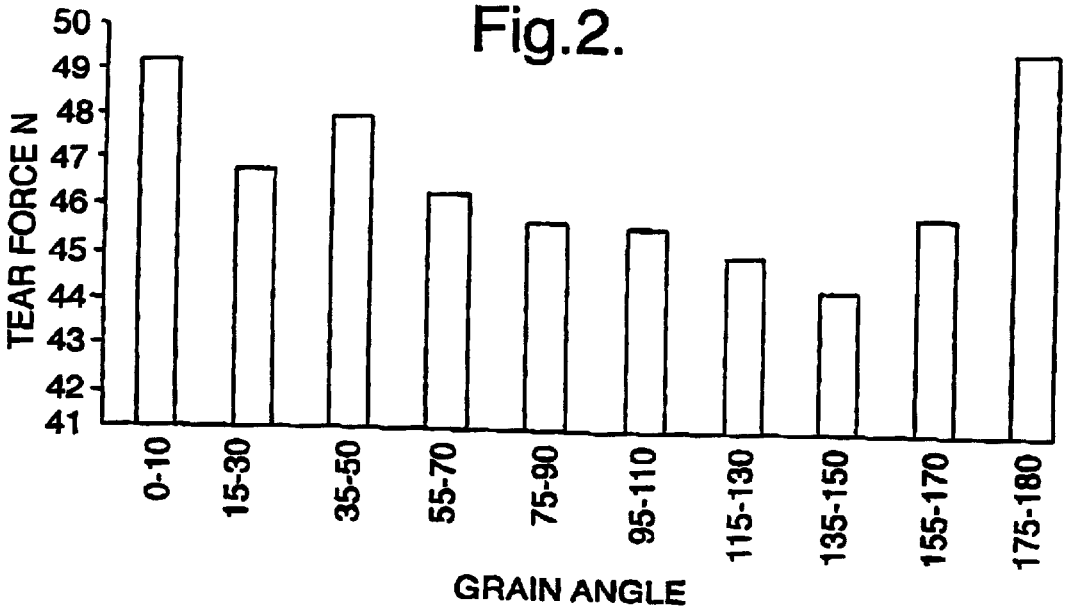
FIG. 2 is a graph showing the effect of grain orientation on tear force for full opening of the can end of FIG. 1.

Not only does FIG. 2 show an unexpectedly high tear force in the 35° to 50° range, but this is also higher than the tear forces in the adjacent ranges, 15° to 30° and 55° to 70°. This variation may be due to the length of chord 40 since tangents 55 and 60 at the ends of the chord are not necessarily at precisely ÷45°. It should be remembered, however, that even if one of the tangents is aligned with the grain, i.e. parallel to the grain, which results in a lower tear force component along that tangent, the tear force component along the tangent at the opposite end of the chord may not be particularly low and the tear force is the sum of these components.

The Applicant has surprisingly found a further factor which influences tear force. After popping the score, different score depths were measured at the ends of the chord 40. At a grain angle of 45°, the score residual was 127 $\mu$m whereas the residual at 135° was 119 $\mu$m. This explains why the tear force is lowest at 135° since the grain angle coincides with minimum score residual at that angle.

If the tear force component is across the grain at minimum score residual, it is not necessarily less than the other component which may be along the grain and at a higher score residual. Ideally, therefore, it appears that the grain should be aligned to the tangent at she end of the score having minimum score residual.

In order to determine what was causing this variation in score residual and if positioning the tab so as to align the grain could also take into consideration any changes in score residual, residuals around the score were measured for a series of can ends produced in the same conversion press. These results are given in table 1.

The score (i.e. the score residual thickness) is measured in table 1 at the 1 o'clock, "score 1", and 11 o'clock, "score 11" positions. From the table it is clear that the values for score 11 are always significantly greater than those of score 1, the average difference being 8 microns greater.

This variation is typical for all conversion presses. In the conversion, the progression is to form the score and then a rivet and finally locate the tab. The residual will therefore always be the same relative to the tab position. In order to control the score residual it is therefore necessary to modify either the score die or the anvil which supports the end for scoring. In practice, the Applicant has found the latter to be easier to modify, for example by coating the anvil to reduce score residual.

The end of the present invention is manufactured using conventional shell manufacturing steps, where a shell is first pressed and any lining compound inserted, after which the shell is indexed into the conversion press for score, rivet and tab to be added. A camera is used to check grain orientation as the shell is indexed into the conversion press and a lifter and servomotor driven turntable orient the end to the desired grain angle. Modifications to the conversion press ensure that score residual is minimum when the grain is oriented to the expected chord tangent. This tangent varies according to the end diameter, typically being in the following quadrants:

| Diameter (mm) | Degrees |
|---|---|
| 65 | 30–50 |
| 73 | 24–45 |
| 84 | 20–40 |
| 99 | 18–38 |

It will be appreciated that the invention has been described above by way of example only and that changes may be made within the scope of the invention as defined by the claims. For example, the end may be oriented in a variety of manners and in any suitable part of the manufacturing process, provided that such orientation is not lost prior to tab positioning.

TABLE 1

| | Score 1 (microns) | Score 11 (microns) | Difference (microns) |
|---|---|---|---|
| | 120 | 126 | 5.91 |
| | 120 | 126 | 5.91 |
| | 118 | 128 | 9.84 |
| | 118 | 128 | 9.84 |
| | 120 | 128 | 7.87 |
| | 122 | 128 | 5.91 |
| | 122 | 128 | 5.91 |
| | 120 | 128 | 7.87 |
| | 122 | 128 | 5.91 |
| | 118 | 126 | 7.87 |
| | 120 | 128 | 7.87 |
| | 120 | 130 | 9.84 |
| | 120 | 130 | 9.84 |
| | 118 | 132 | 13.78 |
| | 120 | 132 | 11.81 |
| | 122 | 134 | 11.81 |
| | 124 | 130 | 5.91 |
| | 126 | 130 | 3.94 |
| | 124 | 128 | 3.94 |
| | 120 | 128 | 7.87 |
| Averages: | 121 | 129 | 8 |

What is claimed is:

1. A metal can end (5) comprising a removable full aperture central panel (20); a circumferential score (10) surrounding the central panel (20); and a tab (15) fixed to the central panel (20) so as to be substantially adjacent the circumferential score (10) with a longitudinal axis of the tab (15) aligned along a radius of the metal can end (5) such that, when the tab (15) is raised, an arc (45) of the circumferential score (10) is broken, the arc (45) having a chord (40) joining its ends; and the metal can end (5) having a grain direction disposed at an angle of between ±15° to 60° to the longitudinal axis of the tab (15).

2. An end according to claim 1, in which the end has a diameter of 80 to 100 mm and the grain angle is 15° to 45°.

3. An end according to claim 1, in which the end has a diameter of 60 to 80 mm and the grain angle is 20° to 60°.

4. An end according to claim s 1, in which a tangent in the plane of the end and at one end of the chord to the arc which is formed when the tab is raised, is parallel to the grain of the end.

5. An end according to claim 4, in which the grain is between +/−10° to the tangent.

6. An end according to claim 4, in which the score has a residual which is lower at the end of the chord having the tangent to which the grain is aligned than at the other.

7. An end according to claim 5, in which the score has a residual which is lower at the end of the chord having the tangent to which the grain is aligned than at the other.

8. A metal can end (5) comprising a removable full aperture central panel (20); a circumferential score (10) surrounding the central panel (20); and a tab (15) fixed to the central panel (20) so as to be substantially adjacent the circumferential score (10) such that, when the tab (15) is raised, an arc (45) of the circumferential score (10) is broken, the arc (45) having a chord (40) joining its ends; and the metal can end (5) having a grain direction which is parallel to a tangent to the metal can end (5) in the same plane as the metal can end (5) and at one end of the chord (40).

9. An end according to claim 8, in which the grain is between +/−10° to the tangent.

10. An end according to claim 8, in which the score has a residual which is lower at the end of the chord having the tangent to which the grain is aligned than at the other.

11. A method of making a can end comprising:

cutting blanks from metal sheet;

forming the blanks into end shells;

lining the shells;

feeding the shells into a conversion press;

determining the grain direction of each shell;

positioning each shell until the grain direction of the shell is substantially parallel to a predetermined tangential position;

forming a circumferential score (10) on each shell to define a full opening central panel (20); and fixing a tab (15) to the full opening central panel (20) of each shell with a longitudinal axis of the tab (15) being disposed ±15° to 60° to the shell grain direction.

12. A method of making a can end comprising:

cutting blanks from a metal sheet;

forming the blanks into end shells;

lining the shells;

feeding the shells into a conversion press;

determining the grain direction of each shell;

positioning each shell until the grain direction of the shell is substantially parallel to a predetermined tangential position;

forming a circumferential score (10) on each shell to define a full opening central panel (20); and fixing a tab (15) to the full opening central panel (20) of each shell with the grain direction being parallel to a tangent at least at one of two opposite ends of a hinge line chord formed by an opening force being applied by the tab to the circumferential score (10).

* * * * *